US007526865B2

(12) United States Patent
Mueller

(10) Patent No.: US 7,526,865 B2
(45) Date of Patent: May 5, 2009

(54) UTILITY KNIFE WITH REAR GYRE PIVOT STRUCTURE

(76) Inventor: Kristopher Joseph Mueller, 7 Pine Ridge Rd., Asheville, NC (US) 28804

( * ) Notice: Subject to any disclaimer, the term of this patent is extended or adjusted under 35 U.S.C. 154(b) by 190 days.

(21) Appl. No.: 11/593,181

(22) Filed: Nov. 6, 2006

(65) Prior Publication Data

US 2008/0104849 A1 May 8, 2008

(51) Int. Cl.
*B26B 3/00* (2006.01)
*B26B 11/00* (2006.01)

(52) U.S. Cl. ..... 30/123; 30/286; 30/298

(58) Field of Classification Search ..... 30/123, 30/125, 286, 162, 2, 298; 7/158
See application file for complete search history.

(56) References Cited

U.S. PATENT DOCUMENTS

| | | | | | |
|---|---|---|---|---|---|
| 4,062,116 | A | | 12/1977 | Arnott | |
| 4,197,605 | A | | 4/1980 | King | |
| 4,240,202 | A | * | 12/1980 | Gilbert | 30/162 |
| RE32,501 | E | | 9/1987 | Okada | |
| 4,797,963 | A | | 1/1989 | Gulino | |
| 4,809,437 | A | | 3/1989 | Saliaris | |
| 4,868,985 | A | * | 9/1989 | Rehm | 30/162 |
| 4,910,821 | A | * | 3/1990 | Kieferle | 7/158 |
| 4,974,320 | A | | 12/1990 | Pelletier | |
| 5,005,290 | A | * | 4/1991 | Gilbert | 30/162 |
| 5,042,154 | A | * | 8/1991 | Gilbert | 30/162 |
| 5,072,471 | A | | 12/1991 | Isler | |
| 5,203,852 | A | | 4/1993 | Downing et al. | |
| 5,355,588 | A | | 10/1994 | Brandenburg et al. | |
| 5,555,625 | A | | 9/1996 | Scheminger | |
| 5,711,077 | A | | 1/1998 | Schulz et al. | |
| 5,725,727 | A | | 3/1998 | Tutewohl | |
| 5,797,188 | A | * | 8/1998 | Gilbert | 30/330 |
| 6,226,824 | B1 | * | 5/2001 | Hopson et al. | 7/158 |
| 6,317,986 | B1 | * | 11/2001 | Huang | 30/162 |
| 6,484,404 | B1 | | 11/2002 | Kao | |
| 6,748,659 | B1 | * | 6/2004 | Street | 30/2 |
| 7,051,443 | B2 | | 5/2006 | Mueller | |
| 2004/0216309 | A1 | * | 11/2004 | Mueller | 30/286 |
| 2004/0250425 | A1 | * | 12/2004 | Arent et al. | 30/142 |
| 2007/0234484 | A1 | * | 10/2007 | Guffey | 7/158 |
| 2008/0086891 | A1 | * | 4/2008 | Vaes | 30/123 |

* cited by examiner

*Primary Examiner*—Jason Daniel Prone
*Assistant Examiner*—Joseph Defrank
(74) *Attorney, Agent, or Firm*—Jacobson Holman PLLC

(57) ABSTRACT

A heavy duty utility knife structure with rear gyre for balanced stabile cutting using excess force while cutting heavy and thick material. In turn this design becomes safer, easier and is a precision cutting knife to be used in all construction trade including home and hobby as well. With a blade storage and easy hinge opener it is a complete tool.

2 Claims, 3 Drawing Sheets

UTILITY KNIFE WITH REAR GYRE PIVOT STRUCTURE

BACKGROUND OF THE INVENTION

1. Field of the Invention

This invention relates to a hand-held multiple use utility knife structure and specifically a knife with a blade and a wheel assembly. Roofing, drywall, flooring and all installers of the construction trade normally use a standard utility knife to cut and shape material. Since some material is thick and tough, the installer must apply substantial downward pressure on the utility knife to cut through the material. This technique often results in hand injuries. In addition, it is difficult to cut thick and tough material in a straight line using a standard utility knife. Using the knife of the present invention, the user is able to cut thick and heavy duty material. This allows the user to cut more consistent straight lines while working with tough and thick material. This knife will help safety and productivity on the job and in the field.

2. Prior Art

U.S. Pat. No. 6,484,404.
U.S. Pat. No. 4,062,116
U.S. Pat. No. 4,197,605
U.S. Pat. No. Re. 32,501
U.S. Pat. No. 4,797,963
U.S. Pat. No. 4,809,437
U.S. Pat. No. 4,974,320
U.S. Pat. No. 5,072,471
U.S. Pat. No. 5,203,852
U.S. Pat. No. 5,355,588
U.S. Pat. No. 5,555,625
U.S. Pat. No. 5,711,077
U.S. Pat. No. 5,725,727
U.S. Pat. No. 7,051,443

SUMMARY OF THE INVENTION

The present invention includes a utility knife with a proper blade angle matching wheel location inside the knife housing with a pinky finger hub hole, and a rear wheel assembly. Ergonomic features for multiple hand and finger positions provide for a solid grip in any position. A multi-use utility knife with easy change blade holder and blade storage is provided. In further multi-use embodiments on all applied surfaces such as roofing, carpet, dry-wall, cardboard, and fabric where previously a standard utility blade was used. With a hook blade used in roofing, cutting asphalt shingles can be smoother and safer with a more controlled amount of back pull.

A primary objective of this invention is to provide a knife with an internally mounted wheel that will have enough strength for a stabilizer pivot point while rough cutting and precision cutting.

An additional objective is to provide a multi-use tool that could replace tools of lesser function.

Another objective is to provide a simple design for low cost to consumers and manufacturers.

DETAILED DESCRIPTION OF THE PREFERRED EMBODIMENTS

Figure 1:
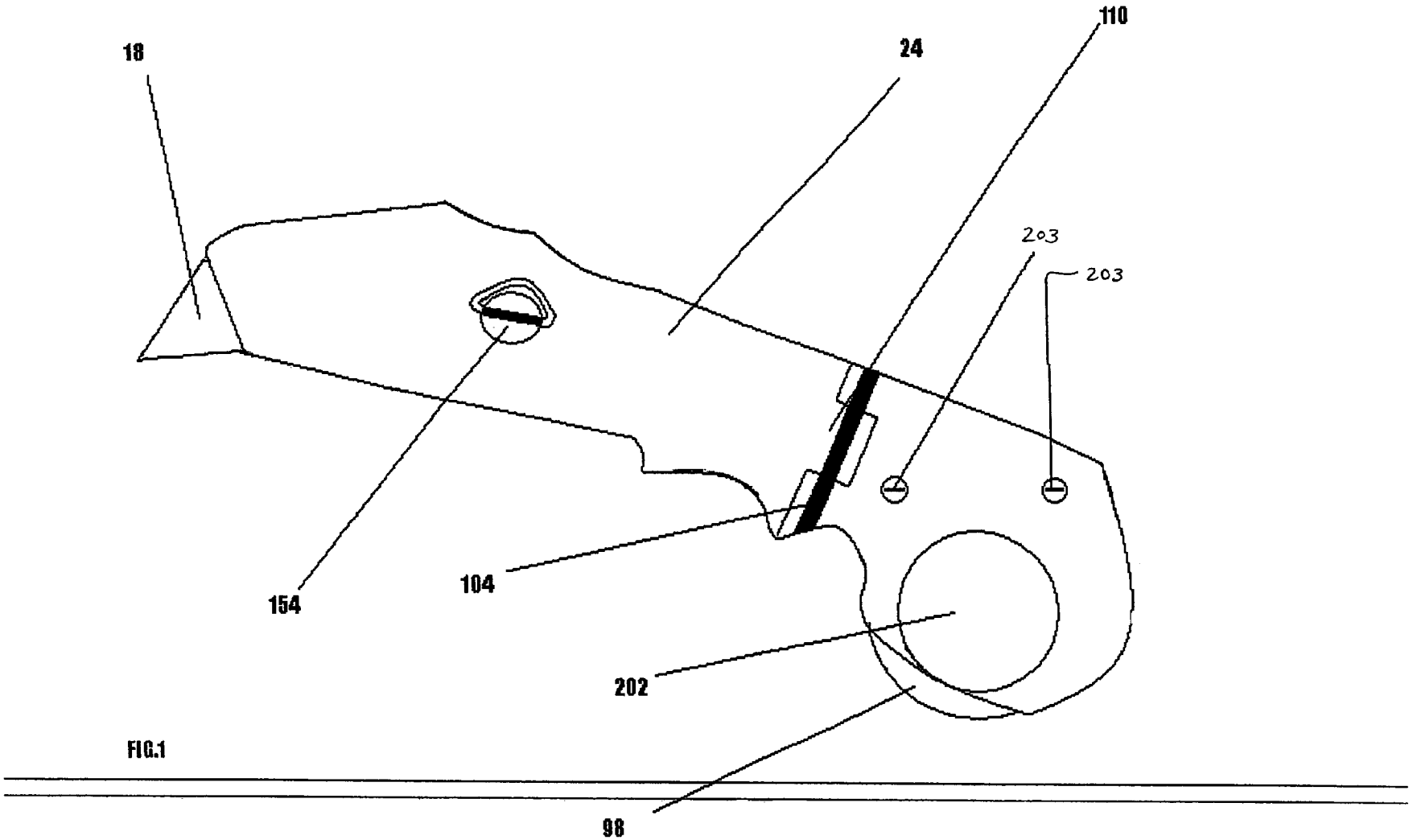
FIG. 1 is a drawing of rear gyre of the present invention.

FIG. 1 shows preferred embodiments of the present invention including a knife housing 24 and a blade 18 combined with a hinge 110 for opening the knife housing so as to access and change the blade 18 by pivoting the housing pieces about hinge pin 104. The housing pieces are fastened together by fastening bail screw 154. The front portion of the knife housing is separate from the rear portion of the knife housing. The rear portion of the knife housing is fastened together with screws 203 near rear gyre hole 202 to hold together both sides of the knife housing at the rear gyre 98 at the opposite end of the knife housing to the blade 18. Along with rear gyre 98 there is a rear gyre hole 202 for the option of hanging the knife, of pulling the knife and for receiving a pinky.

Figure 2:
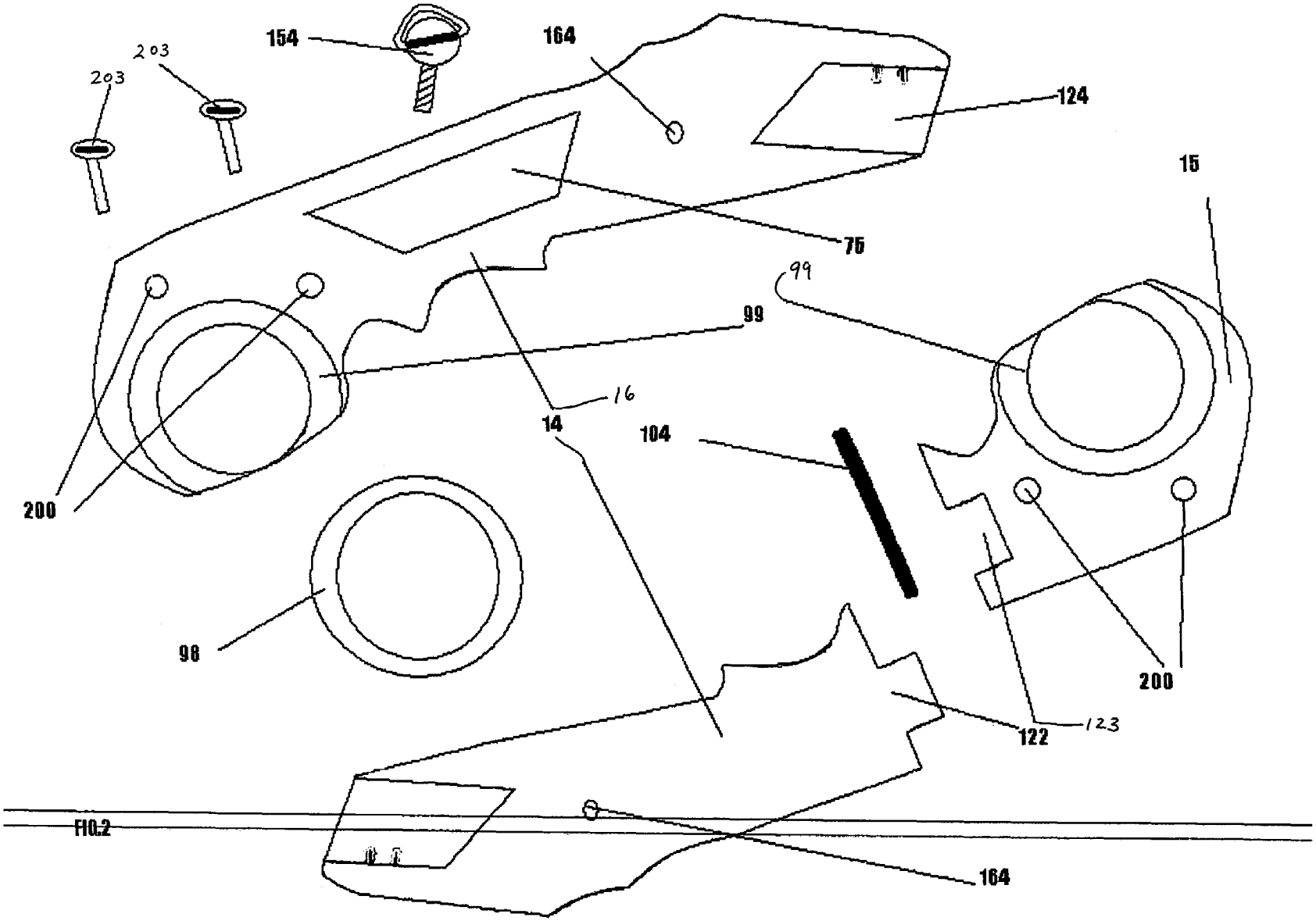
FIG. 2 illustrates an exploded view of all internal embodiments.

FIG. 2 shows the internal embodiments of the knife housing of the present invention. Left housing piece 14 and right housing piece 16 are held together with the fastening bail screw 154 through a fastening hole 164 for the bail screw. Blade holder 124 and blade storage 75 can be accessed with removal of the bail screw 154 and thus opening the knife pieces 14 and 16. The hinge pin 104 allows the hinge side 122 and hinge opening 123 to both lock together. Rear knife housing 15 is fastened together with rear knife housing fastening screws 203 into screw holes 200 for the rear gyre assembly to hold the rear gyre 98 in the rear track 99.

Figure 3:
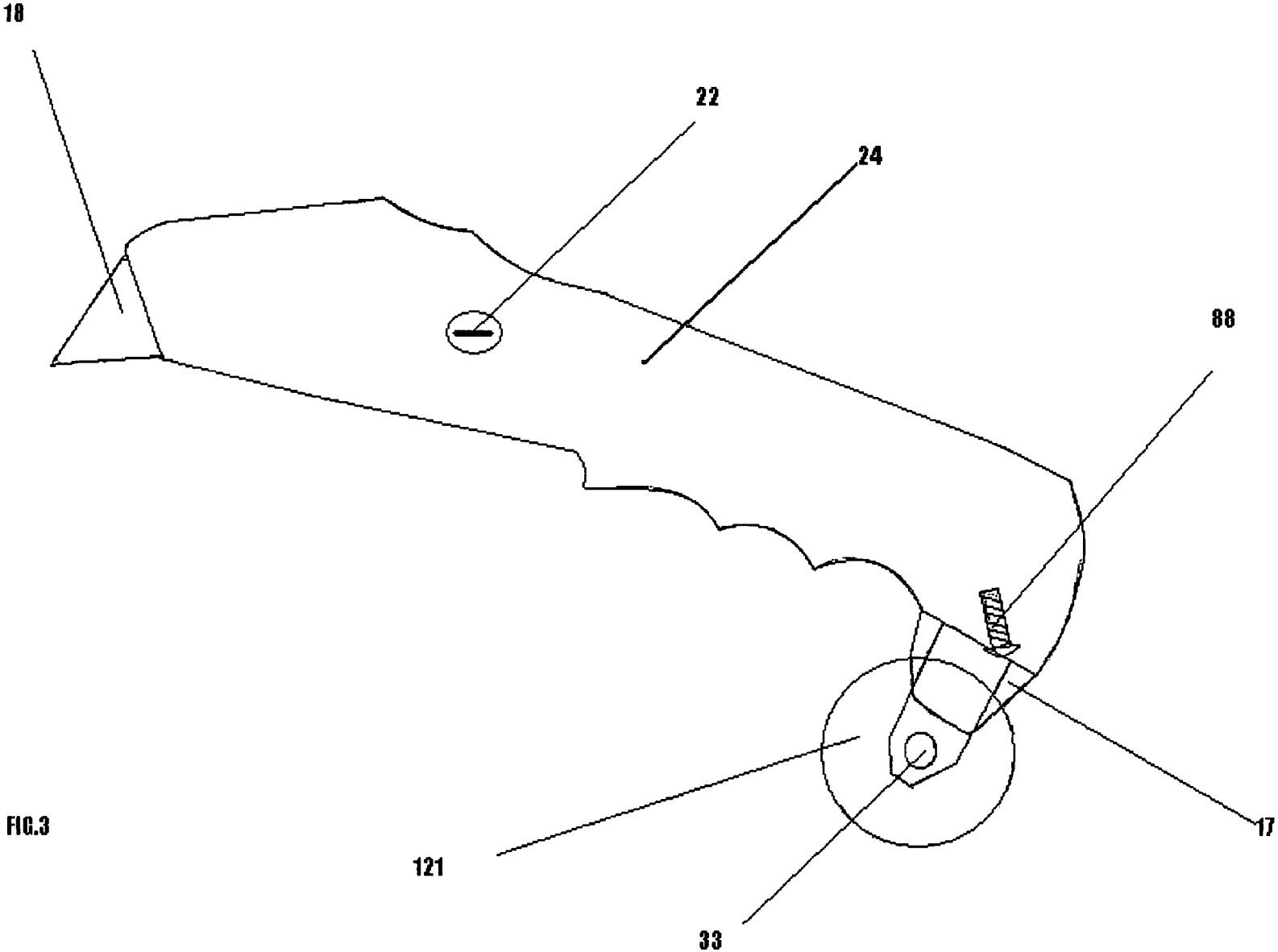
FIG. 3 shows a further embodiment of the present invention.

FIG. 3 shows a further embodiment with fastening screw 22 holding together knife housing 24 in which the rear wheel assembly fastener screw 88 fastens into rear wheel base 17 to fasten the rear wheel 121 and wheel axle 33 to the knife housing 24 at an end opposite to the blade 18.

CONCLUSION

The invention enables an installer using the present invention to readily put downward pressure on the knife and then easily cut through tough and heavy material without the fear of hand injury. In addition, the invention enables construction trade installers to make a very precise cut when using a lot of pressure.

From the foregoing description of the embodiments of the invention, it will be apparent that many modifications may be made therein. It will be understood, however, that these embodiments of the invention are exemplifications of the invention only and that the invention is not limited thereto.

The invention claimed is:

1. A utility knife comprising a housing, said housing having a forward portion, a rear portion, and a middle portion, said forward portion and said rear portion being at opposite terminal ends of the housing, a cutting member, said cutting member being attached to said forward portion, said middle portion having a handle area for a user to grip the housing with a hand, said rear portion containing a gyre of a rear gyre assembly, a portion of the gyre being located inside the housing and a portion of the gyre being located outside the housing, said handle area being located between said cutting member and said rear gyre assembly, said housing having two sides, a storage compartment in said housing, a hinge connecting two portions of one of the two sides of the housing with a hinge pin to create access to the cutting member and the storage compartment, and a fastener securing one of the two portions of the one side of the two sides of the housing to the other side of the two sides of the housing and another fastener securing the other of the two portions of the one side of the two sides of the housing to the other side of the two sides of the housing, the rear gyre assembly remaining in a fixed position between the other of the two portions of the one side of the two sides of the housing and the other side of the two sides of the housing while the one of the two portions of the one side of the two sides of the housing is pivoted away from the other of the two portions of the one side of the two sides of the housing about the hinge pin extending transverse to a longitudinal axis of the housing.

2. The utility knife as set forth in claim 1, wherein the rear gyre assembly further includes an opening extending through said two sides of the housing.

* * * * *